US006765135B2

(12) United States Patent
Takeuchi

(10) Patent No.: US 6,765,135 B2
(45) Date of Patent: Jul. 20, 2004

(54) NECK TRUING DEVICES FOR STRINGED INSTRUMENTS

(75) Inventor: Toshitaka Takeuchi, Aichi-ken (JP)

(73) Assignee: Takeuchi Seisakusho Manufacturing Company, Ltd., Aichi-ken (JP)

( * ) Notice: Subject to any disclaimer, the term of this patent is extended or adjusted under 35 U.S.C. 154(b) by 0 days.

(21) Appl. No.: 10/192,852

(22) Filed: Jul. 11, 2002

(65) Prior Publication Data

US 2003/0010181 A1 Jan. 16, 2003

(30) Foreign Application Priority Data

Jul. 11, 2001 (JP) ..... 2001-211005

(51) Int. Cl.[7] ..... G10D 3/00

(52) U.S. Cl. ..... 84/293; 84/291; 84/267

(58) Field of Search ..... 84/293, 291, 267

(56) References Cited

U.S. PATENT DOCUMENTS 2,460,943 A * 2/1949 Nelson ..... 84/293
5,465,642 A * 11/1995 Goto ..... 84/293
5,696,334 A * 12/1997 Terry ..... 84/293
6,051,765 A * 4/2000 Regenberg et al. ..... 84/293
6,259,008 B1 * 7/2001 Eddinger et al. ..... 84/293

* cited by examiner

*Primary Examiner*—Shih-Yung Hsieh
(74) *Attorney, Agent, or Firm*—Dennison, Schultz, Dougherty & MacDonald

(57) ABSTRACT

Neck truing devices may include a first member that is adapted to be fixedly embedded within the neck of a stringed instrument. A second member may be coupled to the first member and connected across both ends of the first member. An adjusting mechanism may be operable to selectively apply a first force to the first member via the second member in order to correct warpage of the neck in a first direction and a second force to the first member via the second member in order to correct warpage of the neck in a second direction.

9 Claims, 8 Drawing Sheets

NECK TRUING DEVICES FOR STRINGED INSTRUMENTS

This application claims priority to Japanese patent application number 2001-211005 filed Jul. 11, 2001, the contents of which are hereby incorporated herein by reference.

BACKGROUND OF THE INVENTION

1. Technical Field

The present invention relates to truing devices for correcting warpage of necks of stringed instruments and, more particularly, to guitars equipped with such truing devices.

2. Description of the Related Art

When stings are tightened on the neck of a guitar, the guitar neck may warp or bend toward the front side of the guitar due to the tension of strings. In order to correct or eliminate such warpage of the neck, neck truing devices have been proposed. FIGS. 8(A) to 8(D) show a known neck truing device 50 that may be disposed within a longitudinal recess S formed in a neck body M of a neck N of a guitar so as to extend along the longitudinal direction of the neck N, as shown in FIG. 8(E).

Referring to FIGS. 8(A) to 8(D), the known neck truing device 50 includes a first bar-shaped member 52 having a substantially U-shaped cross section. A second bar-shaped member 54 is disposed within the first bar-shaped member 52 and serves as a core. A stopper 54*s* is formed at the forward end (left end as viewed in FIG. 8(A)) of the second bar-shaped member 54 and is disposed externally of the forward end of the first bar-shaped member 52. A nut 56 is fitted into the rear end portion of the first bar-shaped member 52, so that the nut 56 can rotate relative to the first-bar-shaped member about the longitudinal axis. A female thread 56*w* is defined within the nut 56. A male thread 54*m* is defined on the base end portion of the second bar-shaped member 54 and threadably engages the female thread 56*w*. A plate 58 is disposed between a bottom surface 52*b* (upper surface as viewed in FIG. 8(A)) of the U-shaped groove defined within the first bar-shaped member 52 and an upper surface of the second bar-shaped member 54. As shown in FIG. 8(C), the second bar-shaped member 54 is partially curved or bent before the device 50 is disposed within the neck N.

According to this known arrangement, when an operator tightens the nut 56, a tensile force is produced and is applied to the second bar-shaped member 54 due to the threaded engagement of the male thread 54*m* and female thread 56*w*. As a result, the second bar-shaped member 54 causes the first bar-shaped member 52 to curve upwards from the position shown in FIG. 8(C) by cooperating with the plate 58 (See FIG. 8(D)). As shown in FIG. 8(E), the device 50 is embedded along the longitudinal recess S of the neck N such that the bottom surface 52*b* of the U-shaped groove of the first bar-shaped member 52 is positioned on the front side (upper side of as viewed in FIG. 8(E)) of the neck N. A finger board F is attached to the neck N, so that the device 50 is fixedly enclosed within the neck N. Therefore, by adjusting the degree of curvature of the first bar-shaped member 52 by means of the nut 56, it is possible to correct warpage of (i.e., true or straighten) the neck N, which warpage may be caused due to the tension applied across the neck N by the strings.

The curvature of the first bar-shaped member 52 of the known neck truing device 50 can be varied in one direction by tightening the nut 56 in order to cope with the warpage of the neck N caused by the tension of the strings. However, the device 50 cannot cope with warpage in other directions.

For example, depending on the condition of the material of the neck N (typically, the neck N is made of wood), the neck N may possibly warp toward the rear side of the guitar against the tension of the strings applied to the neck N. In such cases, the known truing device 50 cannot correct warpage of the neck N.

SUMMARY OF THE INVENTION

Therefore, it is one object of the present teachings to provide improved devices for correcting warpage of necks of stringed instruments. For example, in one aspect of the present teachings, neck truing devices may include a first member that is adapted to be fixedly disposed within the neck of the string instrument. A second member may be coupled to the first member and may be connected between or across the respective ends of the first member. An adjusting mechanism may serve to apply a first force and a second force to the first member via the second member in order to respectively correct the warpage of the necks in opposing directions. According to the present specification, the term "truing" is intended to mean adjusting or restoring the neck to a desired mechanical accuracy or form. If the neck of the stringed instrument is normally straight, then the neck truing device may be utilized to straighten the neck, if the neck has warped. However, the necks of some stringed instruments are normally curved. Thus, in such cases, the neck truing device may be utilized to return the neck to the desired curved configuration.

In one embodiment of the present teachings, the first member may be bent in a first direction when the first bending force is applied to the first member. On the other hand, the first member also may be bent in a second direction opposite to the first direction. In this case, when the neck has been warped toward a front side of the neck due to string tension, the first force may be applied to bend the neck toward the rear side by the adjusting mechanism so as to eliminate the warpage. On the other hand, when the neck has been warped toward the rear side, the second force may be applied to bend the neck toward the front side by the adjusting mechanism so as to eliminate the warpage in the rear side. As a result, warpage of the neck can be appropriately corrected or eliminated in response to the direction of warpage.

In another aspect of the present teachings, the adjusting mechanism may include a pull/push mechanism that may apply a pulling force and a pressing force to one end of the first member via the second member. In another aspect of the present teachings, one end of the first member may be fixedly connected to one end of the second member and the pull/push mechanism may be interposed between the other end of the first member and the other end of the second member. In another aspect of the present teachings, the pull/push mechanism may include a screw that is operable by an operator.

In another aspect of the present teachings, a control device may serve to control the bending direction of the first member in response to application of the respective first and second forces.

In another aspect of the present teachings, guitars are taught that may include the truing devices according to the aforementioned various aspects.

Additional objects, features and advantages of the present invention will be readily understood after reading the following detailed description together with the accompanying drawings and the claims.

DETAILED DESCRIPTION OF THE INVENTION

Figure 1:
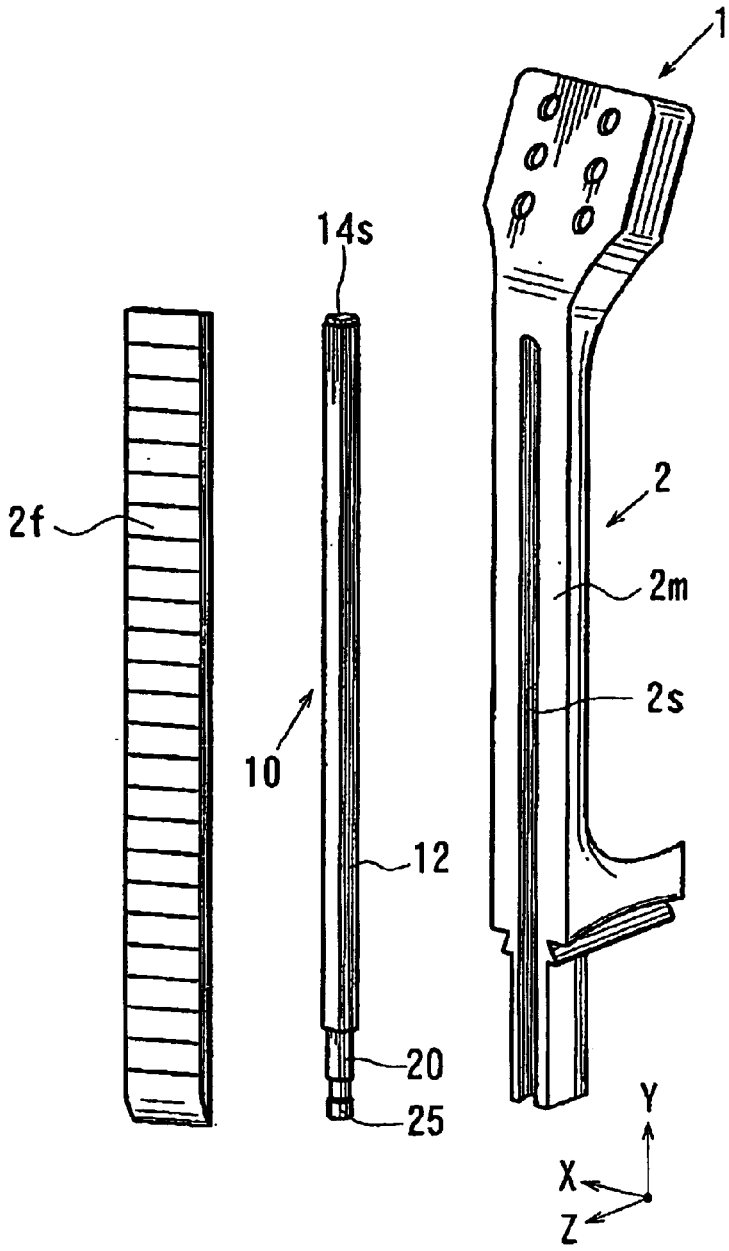
FIG. 1(A) is an exploded perspective view of a neck of a guitar and a first representative neck truing device.
FIG. 1(B) is a cross-sectional view of the first representative neck truing device when it is disposed within the neck.
Figure 1:
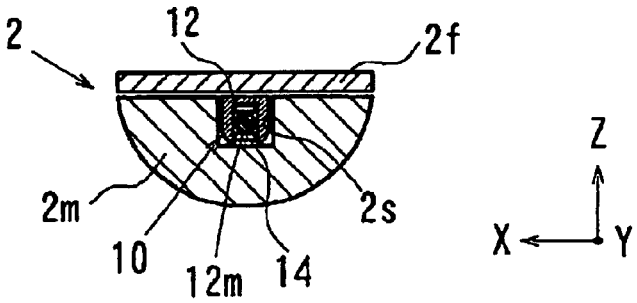

In one embodiment of the present teachings, devices for correcting warpage of necks of stringed instruments may include a first bar-shaped member that extends along the longitudinal direction of the neck. A second bar-shaped member may extend along the first bar-shaped member. A first end portion of the second bar-shaped member may be fixed to a first end portion of the first bar-shaped member. A pull/push mechanism may be mounted on a second end portion of the first bar-shaped member and may apply a tensile force and a pressing force to a second end portion of the second bar-shaped member. A directing member may serve as a control device that directs the first bar-shaped member in one direction when a tensile force is applied to the second bar-shaped member by the pull/push mechanism and in an opposite direction when a pressing force is applied to the second bar-shaped member by the pull/push mechanism.

Therefore, when the tensile force is applied to the second bar-shaped member, the first bar-shaped member may bent or curved in one direction by the operation of the directing member. On the other hand, when a pressing force is applied to the second bar-shaped member, the first bar-shaped member may be curved in the other (opposite) direction by the operation of the directing member. As a result, not only the neck warpage due to the tension of the strings, but also warpage due to other factors, can be appropriately corrected or eliminated by the present truing devices.

In another embodiment of the present teachings, the pull/push mechanism may include a first actuation mechanism and a second actuation mechanism that is operationally connected with the first actuation mechanism so as to transmit an output of the first actuation mechanism to the second bar-shaped member. This arrangement may enable to a relatively small operational force to be converted into a relatively large output. Optionally, an actuation ratio of the first actuation mechanism may be different from an actuation ratio of the second actuation mechanism.

In another embodiment of the present teachings, the first actuation mechanism may include at least one component that also constitutes a component of the second actuation mechanism. For example, the first actuation mechanism and the second actuation mechanism may share a screw.

Preferably, the first actuation mechanism may include a first female thread and a first male thread. The first female thread may be formed in the second end portion of the first bar-shaped member. The first male thread may be formed on a screw and may threadably engage the first female thread. The second actuation mechanism may include a second male thread and a second female thread. The second male thread may be formed on the second end portion of the second bar-shaped member. The second female thread may be formed inside the screw and may threadably engage the second male screw.

In another embodiment of the present teachings, the first bar-shaped member may extend along a straight line and the second bar-shaped member may be curved when no tensile force or pressing force is applied to the second bar-shaped member. In another embodiment of the present teachings, the first bar-shaped member may include a longitudinal groove sized to accommodate the second bar-shaped member. In another embodiment of the present teachings, the directing member may include a plate that is disposed between a bottom of the groove of the first bar-shaped member and the second bar-shaped member. Preferably, a width of the groove of the first bar-shaped member and an outer diameter of the second bar-shaped member may be set to be substantially equal to each other, and the directing member may comprise side walls of the groove of the first bar-shaped member.

In another embodiment of the present teachings, the second bar-shaped member may be substantially coaxially disposed within the first bar-shaped member. In the alternative, the second bar-shaped member may be disposed in juxtaposed relationship with the first bar-shaped member and may extend substantially in parallel to the first bar-shaped member.

In another embodiment of the present teachings, guitars are taught that may include the truing devices according to the aforementioned various embodiments.

Each of the additional features and teachings disclosed above and below may be utilized separately or in conjunction with other features and teachings to provide improved neck truing devices for stringed instruments and guitars having such devices, and methods for designing and using such devices and guitars. Representative examples of the present invention, which examples utilize many of these additional features and teachings both separately and in conjunction, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

A first representative neck truing device (neck warpage correcting device) 10 will now be described with reference to FIGS. 1(A) and 1(B), FIG. 2, FIGS. 3(A) to 3((D), FIGS. 4(A) to 4(C) and FIG. 5. FIG. 1(A) shows a guitar 1 that includes a neck 2. The representative neck truing device 10 may be incorporated within the neck 2. The parts of the guitar 1 other than the neck 2 are not shown for purpose of illustrating the essential aspects of the present teachings. In FIGS. 1(A) and 1(B), FIG. 2, FIGS. 3(A) to 3((D), FIGS. 4(A) to 4(C) and FIG. 5, an X-axis, a Y-axis and a Z-axis are indicated by corresponding arrows. The X-axis, the Y-axis and the Z-axis respectively represent the widthwise (lateral) direction, the lengthwise (longitudinal) direction and the direction of thickness (or depth) of the neck 2. In these drawings, the arrow indicating the Z-axis direction is oriented toward the front side of the neck 2.

Referring to FIGS. 1(A) and 1(B), the neck 2 of the guitar 1 may include a flat finger-board 2*f* that covers the front surface of a neck body 2*m*. An elongated groove 2*s* may defined in the center (in the widthwise direction) of the front surface of the neck body 2*m*. The groove 2*s* preferably extends along the Y-direction (lengthwise direction) from the base end (lower end as viewed in FIG. 1(A)) to a position near the tip or terminal end (upper end as viewed in FIG. 1(B)) of the neck body 2*m*. Preferably, the elongated groove 2*s* may have a substantially U-shaped cross-section. The representative neck truing device 10 may be accommodated and secured within the elongated groove 2*s*. The neck 2 may be, e.g., made of wood.

The first representative neck truing device 10 may include a first bar-shaped member 12 whose length, width, and depth are substantially the same as those of the elongated groove 2*s* formed in the neck body 2*m*. That is, the shape of the first bar-shaped member 12 preferably substantially corresponds to the configuration of the elongated groove 12. The first bar-shaped member 12 may have a substantially U-shaped cross-sectional configuration and a longitudinal groove 12*m* may be defined within the first bar-shaped member 12. As shown in FIG. 1(B), the first bar-shaped member 12 may be accommodated within the elongated groove 2*s* such that the opening of the groove 12*m* is oriented downward (i.e., toward the bottom of the elongated groove 2*s*). Preferably, the first bar-shaped member 12 may be made of an aluminum alloy.

A plurality of thin longitudinal grooves (not shown) optionally may be defined along the outer surface of the first bar-shaped member 12. These grooves may serve to increase the strength of adhesion when the first bar-shaped member 12 is adhered to the inner wall of the elongated groove 2*s* of the neck body 2*m*.

As shown in FIGS. 4(A), 4(B) and 4(C), a core-like second bar-shaped member 14 may be disposed or accommodated within the groove 12*m* of the first bar-shaped member 12. A flange-shaped stopper 14*s* may be formed or disposed at the forward end (left end as viewed in FIGS. 4(A) and 4(B)) of the second bar-shaped member 14. The stopper 14*s* may be disposed external to the forward end (left end as viewed in FIGS. 4(A) and 4(B)) of the first bar-shaped member 12. The second bar-shaped member 14 may include a fixing portion 13 that is disposed near the stopper 14*s*. The first bar-shaped member 12 and the second bar-shaped member 14 may be adhered (e.g., caulked) at the fixing portion 13 from the outside of the first bar-shaped member 12. In this case, the forward end portion of the second bar-shaped member 14 will be affixed to the forward end portion of the first bar-shaped member 12.

The stopper 14*s* may primarily function to maintain the relative position of the forward end portion of the first bar-shaped member 12 with respect the forward end portion of the second bar-shaped member 14, in particular, when a tensile force is applied to the forward end portion of the second bar-shaped member 14 toward the right direction as viewed in FIGS. 4(A) and 4(B). In addition, the fixing portion 13 and the caulked portion of the first bar-shaped member 12 may function to maintain the relative position of the forward end portion of the first bar-shaped member 12 with respect the forward end portion of the second bar-shaped member 14, thereby preventing the first bar-shaped member 12 from moving relative to the second bar-shaped member 14, even when a pressing force is applied to the forward end portion of the second bar-shaped member 14 in the left direction as viewed in FIGS. 4(A) and 4(B).

The second bar-shaped member 14 preferably may be formed as a cylindrical tube and may have an outer diameter that is substantially equal to the width of the elongated groove 12*m* of the first bar-shaped member 12. Further, a plurality of pieces of resin tape 14*j* may be wound around the outer peripheral surface of the second bar-shaped member 14 at a plurality of positions along the longitudinal direction of the second bar-shaped member 14. The resin tapes 14*j* may serve to prevent the generation of vibrations (or dampen vibrations) between the first bar-shaped member 12 and the second bar-shaped member 14. The second bar-shaped member 14 may be preferably made of iron, steel or any other suitable material. Preferably, the rigidity of the second bar-shaped member 14 is greater than the rigidity of the first bar-shaped member 12.

Figure 5:
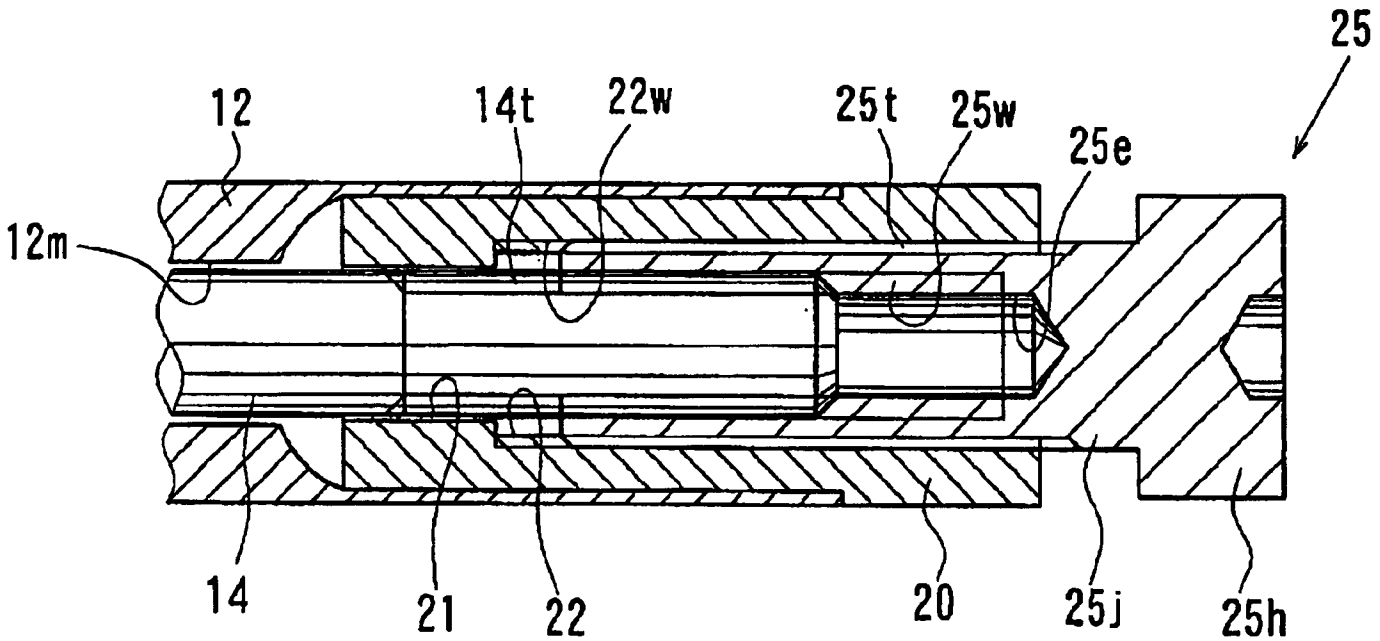
FIG. 5 is an enlarged, cross-sectional plan view of the portion of FIG. 4(A) indicated by numeral V.

Referring to FIG. 5, a male thread 14*t* may be defined on the outer surface of the base end portion (right end portion as viewed in FIGS. 4(A) and 4(B)) of the second bar-shaped member 14. The male screw 14*t* may threadably engage a female thread 25*w* defined on a screw 25, which will be further described below.

Referring to FIG. 4(B), a plate 15 may be disposed or interleaved between the second bar-shaped member 14 and the bottom surface 12*b* of the groove 12*m* of the first bar-shaped member 12. The plate 15 may be attached or affixed to the bottom surface 12*b* of the first bar-shaped member 12 and may serve as a reference point when the first bar-shaped member 12 bows or curves in the upward direction (as viewed in FIG. 4(B)), which will be further explained below. The position of the plate 15 preferably may be appropriately adjusted along the longitudinal direction of the first bar-shaped member 12. In this case, the plate 15 may constitute a directing member for controlling the bowing or bending direction of the first bar-shaped member 12.

Referring to FIGS. 4(A) and 4(B), a block-shaped fixing member 20 may be fixedly attached to the base end portion (right end portion as viewed in FIGS. 4(A) and 4(B)) of the first bar-shaped member 12 by an adhesive or by any other suitable means. As shown in FIG. 5, a small-diameter through-hole 21 and a large-diameter through-hole 22 may be coaxially defined within the fixing member 20. Further, the base end portion of the second bar-shaped member 14 may be inserted into the small-diameter through-hole 21. A female thread 22*w* is preferably defined within the large-diameter through-hole 22 of the fixing member 20. The screw 25 may include a male thread 25*t* that threadably engages the female thread 22*w* from a direction opposite to the second bar-shaped member 14. Thus, the fixing member 20 may essentially serve as a nut for receiving the screw 25.

The screw 25 may include a head portion 25*h* and a shaft portion 25*j*. The male thread 25*t* may be defined on the outer peripheral surface of the shaft portion 25*j*. The female thread

25*w* may be defined on the peripheral wall of a deep axial hole 25*e* that is defined within the shaft portion 25*j*. The male thread 14*t* of the second bar-shaped member 14 may threadably engage the female thread 25*w* of the screw 25.

Preferably, the male thread 25*t* and the female thread 22*w*, as well as the male thread 14*t* and the female thread 25*w*, may be formed as right-handed or clockwise threads. In addition, the pitch of the male thread 25*t* and the female thread 22*w* is preferably different from the pitch of the male thread 14*t* and the female thread 25*w*. For example, the pitch of the male thread 25*t* and the female thread 22*w* may be set at 0.5 mm, and the pitch of the male thread 14*t* and the female thread 25*w* may be set at 0.8 mm.

According to this arrangement, when the male thread 25*t* of the screw 25 rotates in the tightening direction (clockwise direction) with respect to the female thread 22*w* of the fixing member 20, the screw 25 may move deeper into the fixing member 20 (i.e., move to the left as viewed in FIG. 5). At the same time, the male thread 14*t* of the second bar-shaped member 14 and the female thread 25*w* of the screw 25 also may be tightened. In this case, the base end portion of the second bar-shaped member 14 may be pulled by the screw 25 so as to move rightward as viewed in FIG. 5. However, as noted above, the pitch (e.g., 0.5 mm) of the male thread 22*w* is preferably smaller than the pitch (e.g., 0.8 mm) of the male thread 14*t* and the female thread 25*w*. Therefore, the base end portion of the second bar-shaped member 14.

On the other hand, when the male thread 25*t* of the screw 25 rotates in the loosening direction (counter-clockwise direction) with respect to the female thread 22*w* of the fixing member 20, the screw 25 retreats or withdraws from the fixing member 20 (i.e., moves rightward as viewed in FIG. 5). At the same time, the male thread 14*t* of the second bar-shaped member 14 and the female thread 25*w* of the screw 25 may be loosened, so that the base end portion of the second bar-shaped member 14 may be axially pressed by the screw 25 so as to moved leftward as viewed in FIG. 5. Therefore, the base end portion of the second bar-shaped member 14 may move leftward by a distance that corresponds to the difference between the pitch of the male thread 25*t* and the female thread 22*w* and the pitch of the male thread 14*t* and the female thread 25*t*. As a result, an axial pressing force will be applied to the base end portion of the second bar-shaped member 14.

The fixing member 20, the screw 25, the male thread 25*t* and the female thread 22*w* may constitute a first actuation mechanism according to the present teachings. Further, the screw 25, the male thread 14*t* and the female thread 25*w* may constitute a second actuation mechanism according to the present teachings. In addition, a screw mechanism that includes the male thread 25*t*, the female thread 22*w*, the male thread 14*t*, the female thread 25*w*, the fixing member 20 and the screw 25 may constitute a pulling/pressurizing mechanism according to the present teachings. Moreover, the screw 25 may serve as a component of the first actuation mechanism and also may serve as a component of the second actuation mechanism.

Preferably, the fixing member 20 may be made of brass and the screw 25 may be made of iron. In the alternative, the fixing member 20 may be formed of a die-cast zinc alloy in order to reduce manufacturing costs.

A representative method for operating the first representative neck truing device 10 will now be described. As shown in FIGS. 1(A) and 1(B), the neck truing device 10 may be positioned within the elongated groove 2*s* formed in the neck body 2*m* of the neck 2 of the guitar 1 such that the forward end (upper end as viewed in FIG. 1(A)) of the first bar-shaped member 12 substantially contacts the forward end of the elongated groove 2*s*. In addition, adhesive (not shown) may be applied to the outer surface of the first bar-shaped member 12. Then, the first bar-shaped member 12 may be forced (press-fitted) into the elongated groove 2*s* such that the opening of the groove 12*m* opposes the innermost side (bottom side) of the elongated groove 2*s*. After the neck truing device 10 has thus been accommodated within the elongated groove 2*s* of the neck body 2*m*, the finger-board 2*f* may be adhered (e.g., glued) or fixed to the front surface of the neck body 2*m*. As a result, the neck truing device 10 will be embedded and enclosed within the neck 2 to thereby integrate the first bar-shaped member 12 with the neck 2.

As shown in FIGS. 3(A) and 3(C), which show the neck truing device 10 embedded within the neck 2, the first bar-shaped member 12 may extend along a straight line. In this state, no substantial tensile force or pressing force will be applied to the second bar-shaped member 14. Further, the second bar-shaped member 14 will contact the plate 15 and curve or bow slightly downwards.

Figure 2:
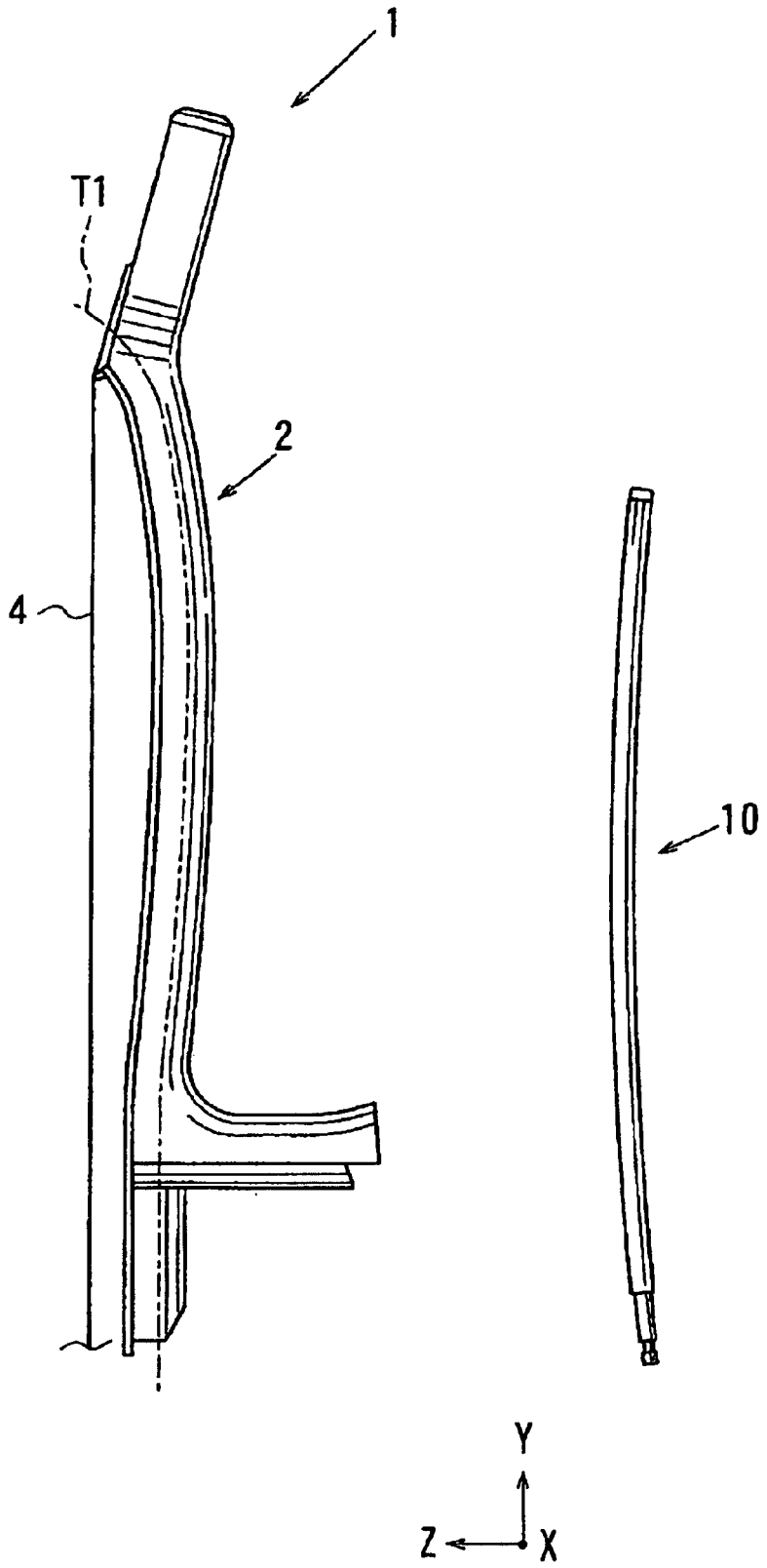
FIG. 2 is a side view showing the warped neck of the guitar and the first representative neck truing device in a curved configuration.
Figure 3:
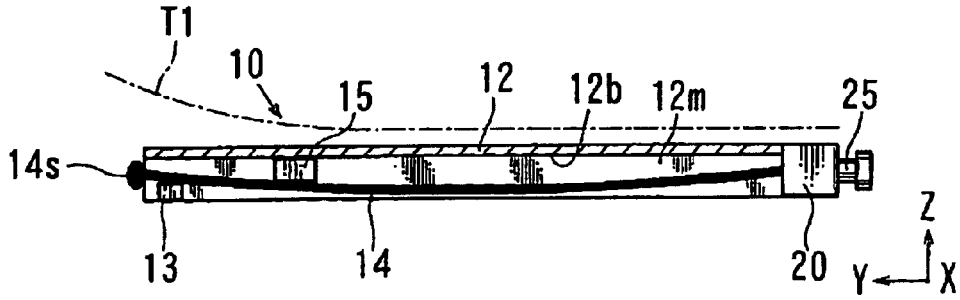
FIGS. 3(A), 3(B), 3(C) and 3(D) are schematic views illustrating the operation of the first representative neck truing device.
Figure 3:
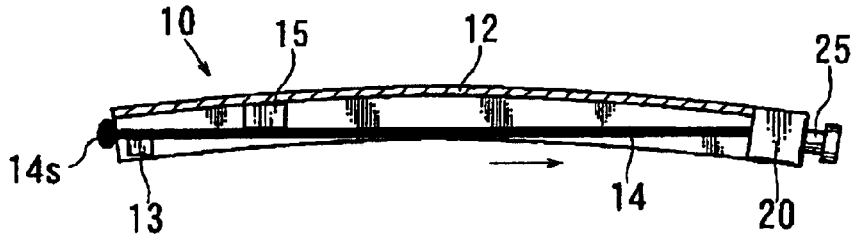
Figure 3:
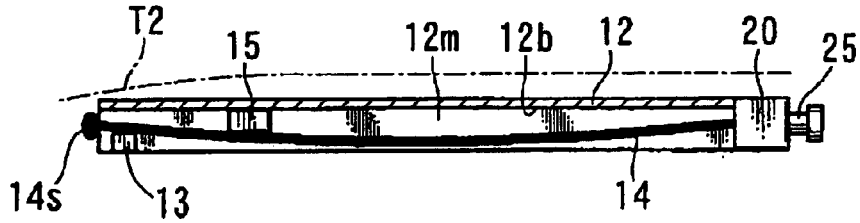
Figure 3:
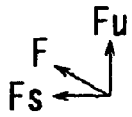
Figure 3:
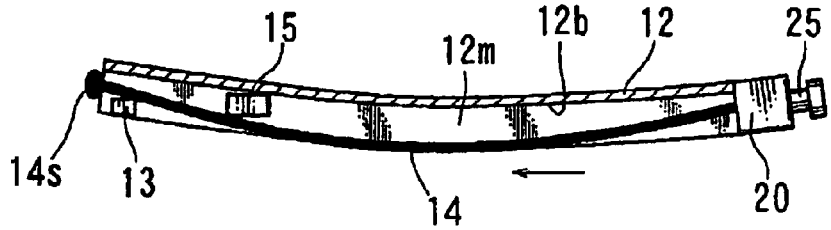
Figure 4:
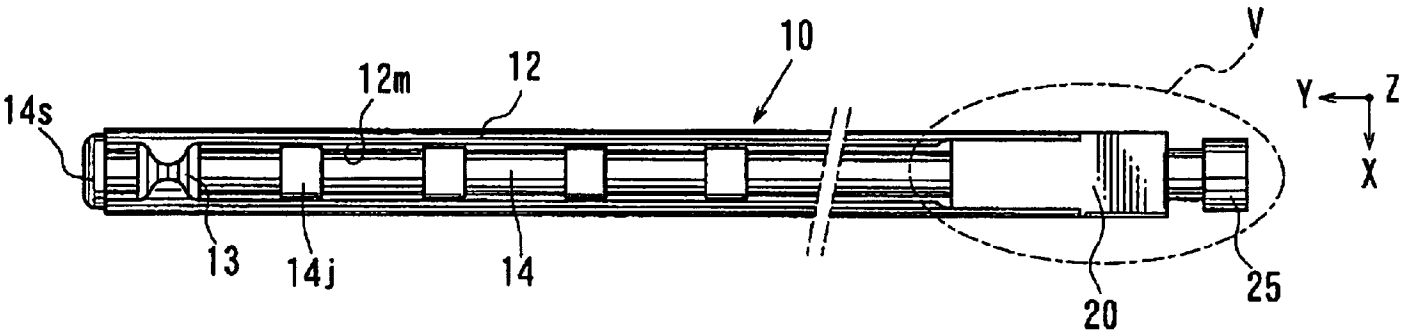
FIGS. 4(A), 4(B) and 4(C) are a plan view, a longitudinal sectional view and a cross-sectional view of the first representative neck truing device.
Figure 4:
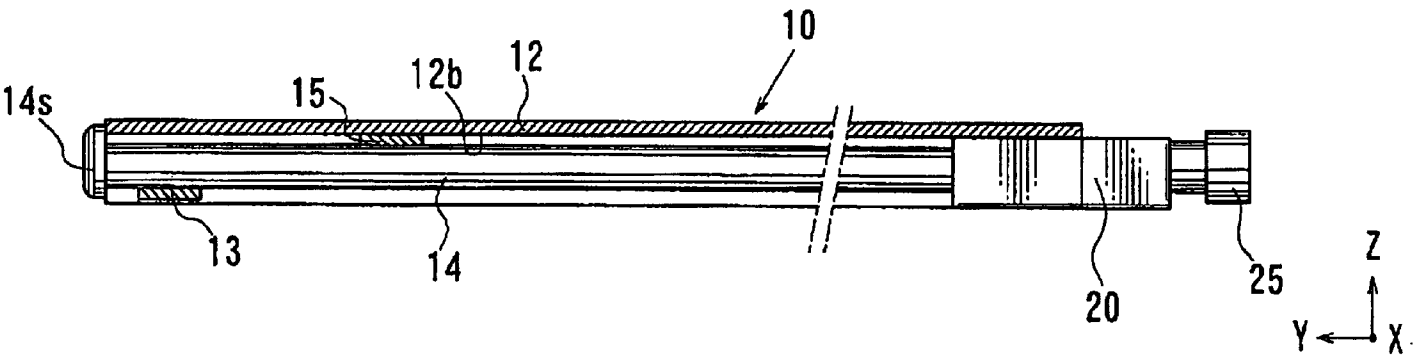
Figure 4:
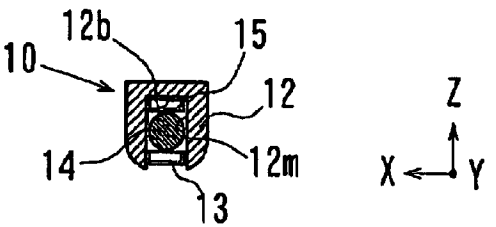

When the neck 2 has been curved or warped toward the front side of the guitar 1 due to the tension of the strings 4, which warpage is indicated by chain lines T1 in FIG. 2 and FIG. 3(A), the operator may rotate screw 25 in the clockwise (tightening) direction. In this case, a tensile force will be applied to the second bar-shaped member 14. As the base end portion of the second bar-shaped member 14 is pulled by the screw 25, the second bar-shaped member 14 will force the first bar-shaped member 12 to curve upward under the directional control of the plate 15, as shown in FIG. 3(B)-As a result, the first bar-shaped member 12 will curve upwards. That is, the first bar-shaped member 12 may be curved or bowed within the neck 2 in a direction that is opposite to the warpage of the neck 2 (indicated by chain lines T1). As a result, the warpage of the neck 2 can be corrected or eliminated and the neck 2 can be straightened. The degree of curvature of the first bar-shaped member 12 can be controlled by adjusting the amount of rotation (i.e., tightening and loosening) of the screw 25.

On the other hand, when the neck 2 has been warped toward the rear side of the guitar 1, which is indicated by chain lines T2 in FIG. 3(C), even the operator may rotate the screw 25 in a counter-clockwise (loosening) direction to thereby push or press the base end portion of the second bar-shaped member 14 in the axial direction. As the base end portion of the second bar-shaped member 14 is pushed in the axial direction, the second bar-shaped member 14 may deform to increase the curvature along and between the side walls of the groove 12*m* of the first bar-shaped member 12, as shown in FIG. 3(D). The forward end portion of the second bar-shaped member 14 may then press the forward end portion of the first bar-shaped member 12 in the axial direction. Because the second bar-shaped member 14 is curved at this time, the forward end portion of the second bar-shaped member 14 will apply a pressing force F to the forward end portion of the first bar-shaped member 12*w* in a direction obliquely upwards. The pressing force F may have a component Fu directed in the Z-direction, which component Fu will push up the forward end portion of the first bar-shaped member 12. As a result, the first bar-shaped member 12 may be curved further downwards.

Thus, according to this representative method, the first bar-shaped member 12 may be curved within the neck 2 in the direction opposite to the warpage of the neck 2 (indicated by chain lines T2 in FIG. 3(C)). Consequently, warpage of the neck 2 can be corrected or eliminated and the neck 2 can be trued or straightened. In the example shown in FIGS. 3(C) and 3(D), the side walls of the groove 12*m* of the first bar-shaped member 12 may serve to determine the curving direction of the first bar-shaped member 12.

As described above, the first representative neck truing device 10 includes a pulling/pressurizing mechanism (e.g., the male thread 25*t*, the female thread 22*w*, the male thread 14*t* and the female thread 25*w*) that is disposed at the base end of the first bar-shaped member 12. Therefore, it is possible to apply a tensile force and a pressing force to the forward end portion of the second bar-shaped member 14. When the tensile force is applied to the second bar-shaped member 14, the first bar-shaped member 12 may curve or bow upwards under the directional control of the plate 15, as shown in FIG. 3(B). In this case, the plate 15 serves as a directing member or a control device for controlling the curving or bowing direction of the first bar-shaped member 12 when the tensile force is applied to the second bar-shaped member 14.

When the pressing force is applied to the second bar-shaped member 14, the first bar-shaped member 12 may curve or bow downwards along the side walls of the groove 12*m* of the first bar-shaped member 12, as shown in FIG. 3(D). In this case, the plate 15 serves as a directing member or a control device for controlling the curving direction of the first bar-shaped member 12 when the pressing force is applied to the second bar-shaped member 14.

Thus, not only the warpage of the neck 2 toward the front side due to the tension of the strings 4, but also the warpage of the neck 2 toward the rear side, can be appropriately corrected or eliminated.

Because means for pulling the second bar-shaped member 12 and means for pressurizing the second bar-shaped member 14 may be integrated into a single unit, i.e. The pulling/pressurizing mechanism, the neck truing device 10 may be relatively compact in size. Further, if the pitch of the male thread 25*t* and the female thread 22*w* is smaller than the pitch of the male thread 14*t* and the female thread 25*w*, the difference between these pitches may produce a force that pulls and presses the other end portion of the second bar-shaped member 14. In this case, the force required by the operator to rotate the screw 25 may be reduced.

Further, by disposing or accommodating the second bar-shaped member 14 within the groove 12*m* of the first bar-shaped member 12, the neck truing device 10 can be made more compact in size.

As described above in the first representative embodiment, the forward portion of the first bar-shaped member 12 and the forward portion of the second bar-shaped member 14 are fixed to each other by caulking the first bar-shaped member 12 at the fixing portion 13 of the second bar-shaped member 14. However, the forward portions of the first and second bar-shaped members 12 and 14 also may be fixed to each other, e.g., by a T-shaped fixing member 26, as shown in FIG. 6, which is a modification of the embodiment shown in FIGS. 1–5.

Figure 6:
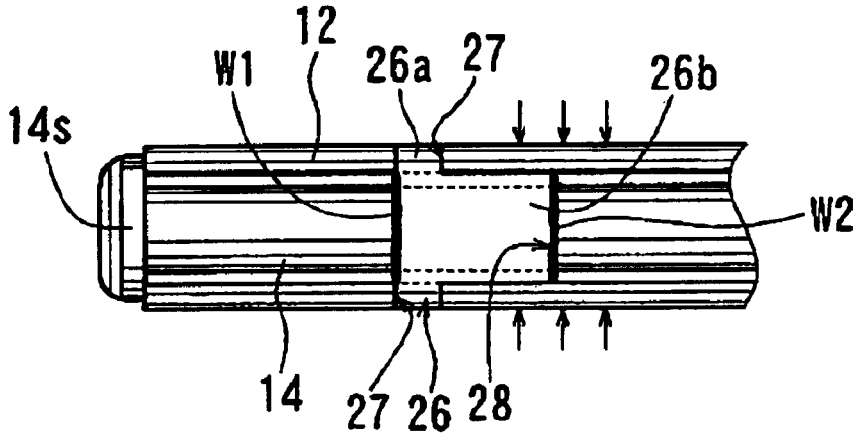
FIG. 6 is a plan view of a forward portion of an alternative neck truing device.

In the alternative embodiment shown in FIG. 6, the fixing member 26 may be made of a plate that has a predetermined thickness. In addition, the fixing member 26 may include a lengthwise portion 26*b* that extends substantially perpendicular to a crosswise portion 26*a*. First recesses 27 may be defined in the upper end surfaces of the first bar-shaped member 12 on the opening side of the U-shape of the first-bar-shaped member 12. The first recesses 27 may serve to closely receive the respective ends of the crosswise portion 26*a* Also, a second recess 28 may be defined in the upper surface of the second bar-shaped member 14 and may serve to closely receive the central portion of the crosswise portion 26*a* and the lengthwise portion 26*b* of the fixing member 26.

In this alternative embodiment, the first bar-shaped member 12 may be caulked against the second bar-shaped member 14 from both lateral sides at a position opposing to the lengthwise portion 26*b* of the fixing member 26, as indicated by arrows shown in FIG. 6. Therefore, the first bar-shaped member 12, the second bar-shaped member 14 and the fixing member 26 may be fixed in position relative to each other. In addition, the fixing member 26 may be welded to the second bar-shaped member 14 at the forward and rearward ends of the second recess 28, e.g., by argon arc welding, as indicated by weld line W1 and W2 shown in FIG. 6. As a result, the forward portions of the first and second bar-shaped members 12 and 14 may be reliably fixed in position relative to each other during the curving or bowing operation of the neck truing device 10.

Figure 7:
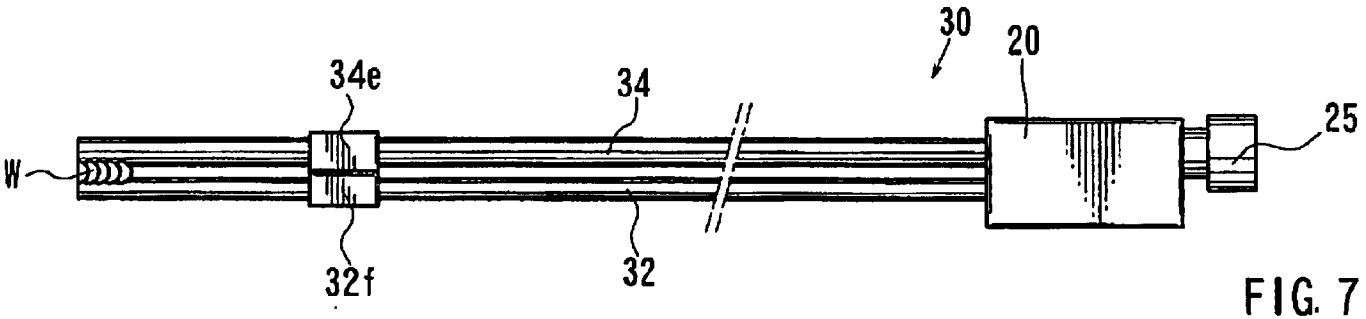
FIG. 7(A) is a side view of a second representative neck truing device.
FIGS. 7(B) and 7(C) are schematic views illustrating the operation of the second representative neck truing device.
Figure 7:
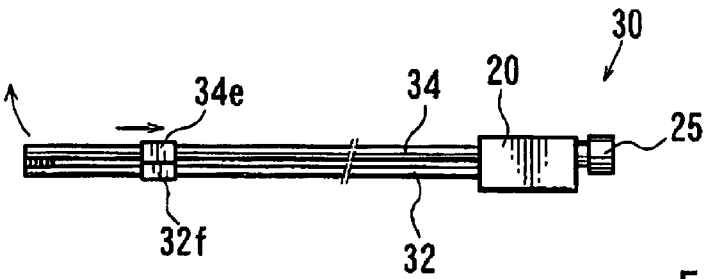
Figure 7:
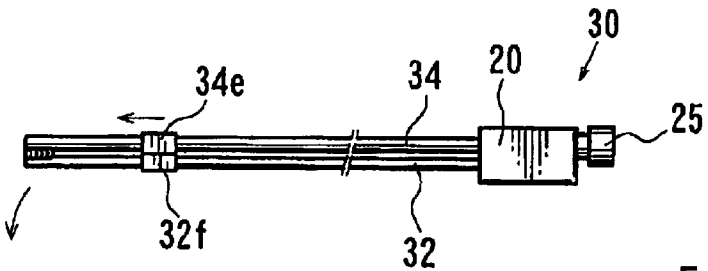
Figure 8:
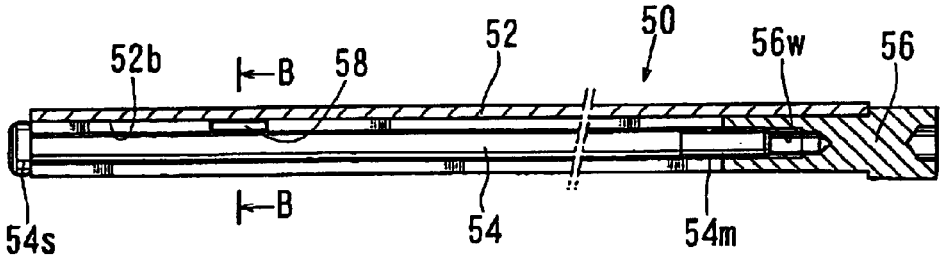
FIG. 8 (A) RELATED ART
FIGS. 8(A) and 8(B) are, respectively, a side view and a cross-sectional view of a known neck truing device.
FIGS. 8(C)and 8(D) are schematic views illustrating the operation of the known neck truing device.
FIG. 8(E) is a cross-sectional view of the known neck truing device embedded within a neck of a guitar.
Figure 8:
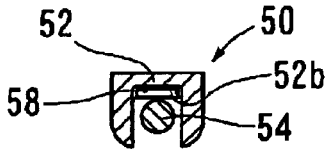
FIG. 8 (B) RELATED ART
Figure 8:
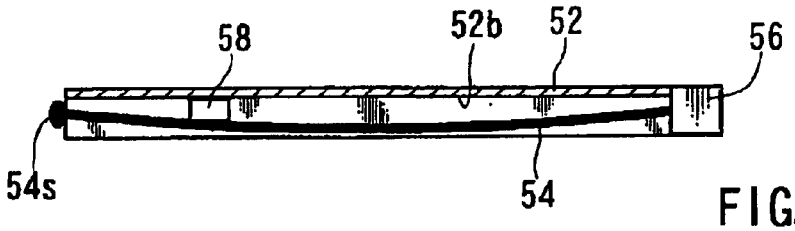
FIG. 8 (C) RELATED ART
Figure 8:
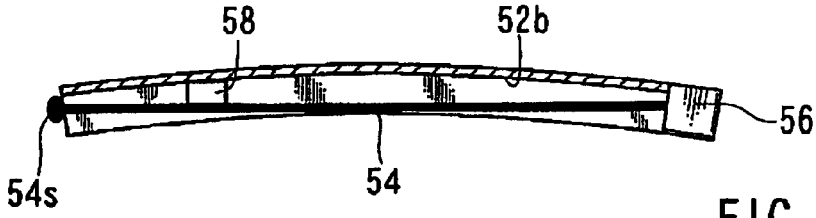
FIG. 8 (D) RELATED ART
Figure 8:
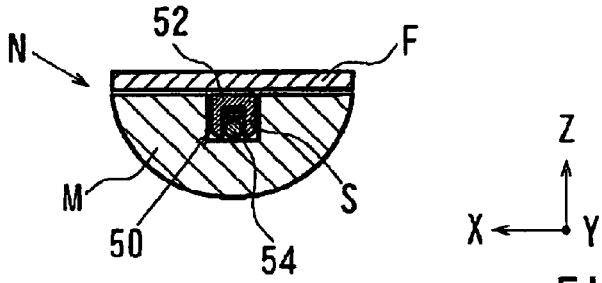
FIG. 8 (E) RELATED ART

A second representative neck truing device 30 will now be described with reference to FIGS. 7(A) to 7(C). As described above, according to the first representative neck truing device 10, the first bar-shaped member 12 has a substantially U-shaped cross-sectional configuration so as to accommodate the second bar-shaped member 14. In the alternative, the second representative neck truing device 30 may include a first bar-shaped member 32 and a second bar-shaped member 34 that each has a substantially cylindrical configuration. Due to this configuration, the first bar-shaped member 32 may be easily manufactured. In addition, the forward end portions of the first and second bar-shaped members 32 and 34 can be connected more easily. Thus, in the second representative neck truing device 30, the second bar-shaped member 34 may be disposed in a juxtaposed relationship with respect to the first bar-shaped member 32. The forward end portions of the first and second bar-shaped members 32 and 34 may be connected, e.g., by welding, as indicated by weld line W shown in FIG. 7(A).

The second representative neck truing device 30 also may include a screw and a fixing member. The construction of the screw and fixing member may be generally the same as the screw 25 and the fixing member 20 of the first representative neck truing device 30. Thus, in FIGS. 7(A) to 7(C), like members are given the same reference numerals as the first representative embodiment and an explanation of these like members is not necessary.

Preferably, the first and second bar-shaped members 32 and 34 of the second representative neck truing device 30 may be made of iron or a similar rigid material. In this case, the outer diameter of the second bar-shaped member 34 may be slightly larger than the outer diameter of the first bar-shaped member 32. As a result, the first bar-shaped member 32 may easily deform (i.e., curve or bow) with respect to the second bar-shaped member 34.

A short cylinder 32*f* may be attached to the outer periphery of the first bar-shaped member 32 at a predetermined position. A short cylinder 34*e* may be attached to the outer periphery of the second bar-shaped member 34 at a position opposing or adjacent to the short cylinder 32*f*. The short cylinder 32*f* of the first bar-shaped member 32 preferably contacts the short cylinder 34*e* of the second bar-shaped member 34 when the second neck truing device 30 is assembled.

Optionally, a plurality of pieces of resin tape (not shown) may be wound around the respective peripheries of the first and second bar-shaped members 32 and 34. The resin tapes wound around the first bar-shaped members 32 may contact the corresponding resin tapes wound around the second bar-shaped members 34. In this case, vibrations may be reliably prevented from occurring (or dampened) between the first and second bar-shaped members 32 and 34.

When the operator rotates the screw 25 in the counter-clockwise direction, a tensile force may be applied to the second bar-shaped member 34. Therefore, the forward end portion of the first bar-shaped member 32 may receive an upward tensile force as shown in FIG. 7(B). Consequently, the first bar-shaped member 32 will curve or bow downwards taking the position of the short cylinders 32*f* and 34*e* as a reference point.

Conversely, when the operator rotates the screw 25 in a clockwise direction, a pressing force may be applied to the base end portion of the second bar-shaped member 34. In this case, the forward end portion of the first bar-shaped member 32 will receive a downward pressing force as shown in FIG. 7(C). As a result, the first bar-shaped member 32 will curve or bow upwards taking the position of the short cylinders 32*f* and 34*e* as a reference point. Therefore, the short cylinders 32*f* and 34*e* also may constitute a directing mechanism (or control device) for determining the curving or bowing direction of the first bar-shaped member 32 of the second representative neck truing device 30.

Thus, in the second representative device 30 as well, warpage of the neck 2 in one direction due to the tension of the strings 4 and the warpage of the neck 2 in the opposite direction may be corrected or eliminated by deforming (curving) of the first bar-shaped member 12 in the appropriate direction. This correction may be performed by simply rotating the screw 25.

The first and second representative embodiments may also be modified in additional ways. For example, the first and second actuation mechanisms of the pulling/pressurizing mechanism in the first representative neck truing devices 10 or the second representative neck truing device 30 are constituted by screw mechanisms. However, in the alternative, the first and second actuation mechanisms may be constituted by another mechanism, such as a lever mechanism. Further, although the first and second representative neck truing devices 10 and 30 were described as being suitable for mounting the neck 2 of the guitar 1, naturally, the present neck truing devices may also be suitable utilized with a variety of other stringed instruments, such as violins and cellos.

What is claimed is:

1. A device for truing a neck of a stringed instrument, comprising:

a first bar-shaped member arranged and constructed to extend along a longitudinal direction of the neck;

a second bar-shaped member arranged and constructed to extend substantially parallel with the first bar-shaped member, wherein a first end portion of the second bar-shaped member is affixed to a first end portion of the first bar-shaped member;

a pull/push mechanism mounted on a second end portion of the first bar-shaped member and being arranged and constructed to apply a tensile force and a pressing force to a second end portion of the second bar-shaped member; and a directing mechanism arranged and constructed to direct the first bar-shaped member in a first direction when a tensile force is applied to the second bar-shaped member by the pull/push mechanism and to direct the first bar-shaped member in a second direction when a pressing force is applied to the second bar-shaped member by the pull/push mechanism, the second direction being opposite to the first direction;

wherein the pull/push mechanism includes:

a first actuation mechanism; and a second actuation mechanism operationally connected with the first actuation mechanism so as to transmit an output of the first actuation mechanism to the second bar-shaped member, the first actuation mechanism having an actuation ratio that is different from an actuation ratio of the second actuation mechanism.

2. A device as in claim 1, wherein the first actuation mechanism shares at least one component with the second actuation mechanism.

3. A device as in claim 1, wherein the first bar-shaped member is arranged and constructed to extend along a straight line when the second bar-shaped member is curved and when no tensile force or pressing force is applied to the second bar-shaped member.

4. A device as in claim 1, further comprising a longitudinal groove defined within the first bar-shaped member, wherein the longitudinal groove receives the second bar-shaped member.

5. A device as in claim 4, wherein the directing mechanism comprises a plate disposed between the second bar-shaped member and a bottom surface of the longitudinal groove.

6. A device as claim 4, wherein the longitudinal groove has a width that is substantially equal to an outer diameter of the second bar-shaped member and the directing mechanism comprises side walls of the longitudinal groove.

7. A device as in claim 1, wherein the second bar-shaped member is substantially coaxially disposed within the first bar-shaped member.

8. A guitar comprising a neck, strings disposed substantially in parallel with the neck and the device of claim 1 disposed within the neck.

9. A device for truing a neck of a stringed instrument, comprising:

a first bar-shaped member arranged and constructed to extend along a longitudinal direction of the neck;

a second bar-shaped member arranged and constructed to extend substantially parallel with the first bar-shaped member, wherein a first end portion of the second bar-shaped member is affixed to a first end portion of the first bar-shaped member;

a pull/push mechanism mounted on a second end portion of the first bar-shaped member and being arranged and constructed to apply a tensile force and a pressing force to a second end portion of the second bar-shaped member; and a directing mechanism arranged and constructed to direct the first bar-shaped member in a first direction when a tensile force is applied to the second bar-shaped member by the pull/push mechanism and to direct the first bar-shaped member in a second direction when a pressing force is applied to the second bar-shaped member by the pull/push mechanism, the second direction being opposite to the first direction;

wherein the pull/push mechanism includes:

a first actuation mechanism; and a second actuation mechanism operationally connected with the first actuation mechanism so as to transmit an output of the first actuation mechanism to the second bar-shaped member.

wherein the first actuation mechanism comprises a screw and includes a first female thread and a first male thread, the first female thread being defined in the second end portion of the first bar-shaped member, and the first male thread being defined on the screw and threadably engaging the first female thread, and wherein the second actuation mechanism includes a second male thread and a second female thread, the second male thread being defined on the second end portion of the second bar-shaped member, and the second female thread being defined within the screw and threadably engaging the second male thread.

* * * * *